US009835394B2

(12) United States Patent
Miller

(10) Patent No.: US 9,835,394 B2
(45) Date of Patent: Dec. 5, 2017

(54) CHARGING HANDLE FOR A FIREARM WITH ANGLED LATCH

(71) Applicant: ZEV Technologies, Inc., Oxnard, CA (US)

(72) Inventor: Michael A. Miller, Tenino, WA (US)

(73) Assignee: ZEV Technologies, Inc., Oxnard, CA (US)

( * ) Notice: Subject to any disclaimer, the term of this patent is extended or adjusted under 35 U.S.C. 154(b) by 0 days.

(21) Appl. No.: 14/869,396

(22) Filed: Sep. 29, 2015

(65) Prior Publication Data

US 2016/0102930 A1 Apr. 14, 2016

Related U.S. Application Data

(60) Provisional application No. 62/056,826, filed on Sep. 29, 2014.

(51) Int. Cl.
*F41A 3/72* (2006.01)

(52) U.S. Cl.
CPC ..... *F41A 3/72* (2013.01)

(58) Field of Classification Search
CPC ..... F41A 7/02; F41A 7/00; F41A 3/72
USPC ..... 89/1.4
See application file for complete search history.

(56) References Cited

U.S. PATENT DOCUMENTS 3,225,653 A * 12/1965 Packard ..... F41A 3/72 42/16
7,832,322 B1 * 11/2010 Hoel ..... F41A 3/20 42/16
8,887,612 B2 11/2014 Bayly
2013/0192113 A1 * 8/2013 Melville ..... F41A 7/00 89/1.4
2015/0276335 A1 * 10/2015 Daley, Jr. ..... F41A 3/66 42/75.01

OTHER PUBLICATIONS

"Tripwire Ambidextrous Charging Handle," Sintercore;<"https://web.archive.org/web/20140720124902/http://sintercore.com/handle"> Published Jul. 20, 2014; accessed via web.archive.org on Sep. 29, 2015.

* cited by examiner

*Primary Examiner* — Stephen Johnson
(74) *Attorney, Agent, or Firm* — Wood Herron & Evans LLP

(57) ABSTRACT

A charging handle having a base and a substantially perpendicularly-oriented cross-member. The cross-member is configured to be received longitudinally within an upper receiver for a firearm with the base being positioned fully forward of the upper receiver. The charging handle further includes a spring-biased charging handle latch that pivots about a fulcrum pin. The charging handle latch has an upper arm and a lower arm. The upper arm includes an angled surface that, when engaged, contacts an upper edge of a charging handle latch pocket within a side of the upper receiver. The lower arm is biased by a compression spring that is positioned within a bore of the base. When engaged, the angled surface of the upper arm is retained within the latch pocket of the upper receiver and creates an angle relative to an imaginary centerline of the charging handle cross-member.

16 Claims, 8 Drawing Sheets

PRIOR ART

PRIOR ART

CHARGING HANDLE FOR A FIREARM WITH ANGLED LATCH

RELATED APPLICATION

This application claims priority to U.S. provisional patent application Ser. No. 62/056,826 filed on Sep. 29, 2014, the contents of which are fully incorporated herein by reference.

TECHNICAL FIELD

The present invention is directed to a charging handle including a latch having an angled surface that contacts an upper edge of the latch pocket such that the charging handle disengages by rearward force alone.

BACKGROUND OF THE INVENTION

Professional military and law enforcement need more versatility in the operation of charging AR style weaponry. Prior art charging handles are known to provide a latch which locks the charging handle in its fully forward position. There have been many upgrades to this design, but most designs have centered about a latch which must be manually released by an operator prior to movement of the charging handle and are not capable of disengagement solely by rearward force alone.

Operation of an AR rifle relies on gas pressure siphoned from its barrel during live fire. This gas pressure is released into the upper receiver in a reduced state during the cycle of the weapon. Further, this gas pressure exerts some force against the combined surface on the charging handle with a net rearward impulse resulting. It is this rearward impulse that the latch must counter.

During operation, forces within the upper receiver act to apply a force against the charging handle in the rearward direction. A charging handle must not move during the operation of the AR rifle (or weapon) in live fire.

A prior art conventional military specification (mil spec) design charging handle 6 is illustrated in FIG. 1. Charging handle 6 is positioned fully forward in an upper receiver 3. A charging handle latch 7 is engaged with a charging handle latch pocket 202 of upper receiver 3. Charging handle 6 is held in place by a pivotable charging handle latch 7 that pivots about a fulcrum pin 8 in relationship to a compression spring 9 and the charging handle latch pocket 202. Compression spring 9 exerts expanding pressure between a bottom of a spring bore and a spring landing of the charging handle. This force causes a clockwise torque around the fulcrum pin 8. In turn, this clockwise torque causes an equal and opposite force at the latch surface 200 directed downward into charging handle latch pocket 202 thereby retaining the charging handle 6 in its forward position.

Particular to a mil spec design, latch surface 200 of the mil spec latch 7 is flat and parallel to a latch pocket surface 201 of charging handle latch pocket 202 as illustrated in FIGS. 1 and 2. To release the mil spec handle 6 for rearward movement, an operator must apply rearward force on a handle surface 203 of mil spec latch 7. This force must cause counterclockwise torque around fulcrum pin 8 sufficient to overcome the retaining clockwise torque exerted by the compression spring 9, thus allowing counterclockwise rotation of the mil spec latch 7 about the fulcrum pin 8. As the mil spec latch 7 rotates, latch surface 200 separates from latch pocket surface 201, and the charging handle moves rearward. However, an operator cannot apply pressure to an opposite side 204 of the mil spec charging handle 6 to move the handle rearward. The mil spec latch 7 would retain forward location by virtue of the engaged latch surfaces 200, 201.

More recently, a charging handle has come onto the market that has a fully rounded latch. In that product, the engaged portion on the latch is fully rounded and drops into its corresponding latch pocket. However, a rounded edge may apply inconsistent force to resist rearward gas impulse.

SUMMARY OF THE INVENTION

The present invention is directed to an improvement to charging handles for firearms over that of known prior art. Particularly, the present charging handle is capable of disengagement from an upper receiver solely by rearward force alone. The charging handle has a base and a substantially perpendicularly-oriented cross-member. The charging handle includes a compression spring biased latch arm with the upper arm including an angled surface that engages with an rearward edge of a latch pocket on the side of an upper receiver. The upper receiver is configured to receive the charging handle cross-member longitudinally of the upper receiver such that the base is fully forward of the upper receiver.

The angled charging handle latch engaged with the rearward edge of the upper receiver creates an angle relative to an imaginary center line of the cross-member. That angle is in the range of 34 to 38 degrees, with a preferred angle of 36 degrees. This angled surface of the charging handle latch provides a consistent force to the rearward edge of the upper receiver latch pocket and is better able to resist inherent rearward gas impulse.

Claims are directed to both the charging handle and the combination of the charging handle and upper receiver. Further, claims are directed to a method of use for using the charging handle of the present invention.

These and other advantages will become more apparent upon review of the drawings, the Detailed Description of the Invention, and the Claims.

BRIEF DESCRIPTION OF THE DRAWINGS

Like reference numerals are used to designate like parts throughout the several views of the drawings, wherein.

DETAILED DESCRIPTION OF THE INVENTION

The charging handle of the present invention operates with a spring loaded angled charging handle latch which will release under the rearward pressure of the handle, independent of any mechanism for release of the same. To release the latch that retains the handle in its forward position, the operator need only apply rearward pressure to either side of the existing grip surfaces. The latch releases at that point with no need of mechanical intervention.

Figure 4:
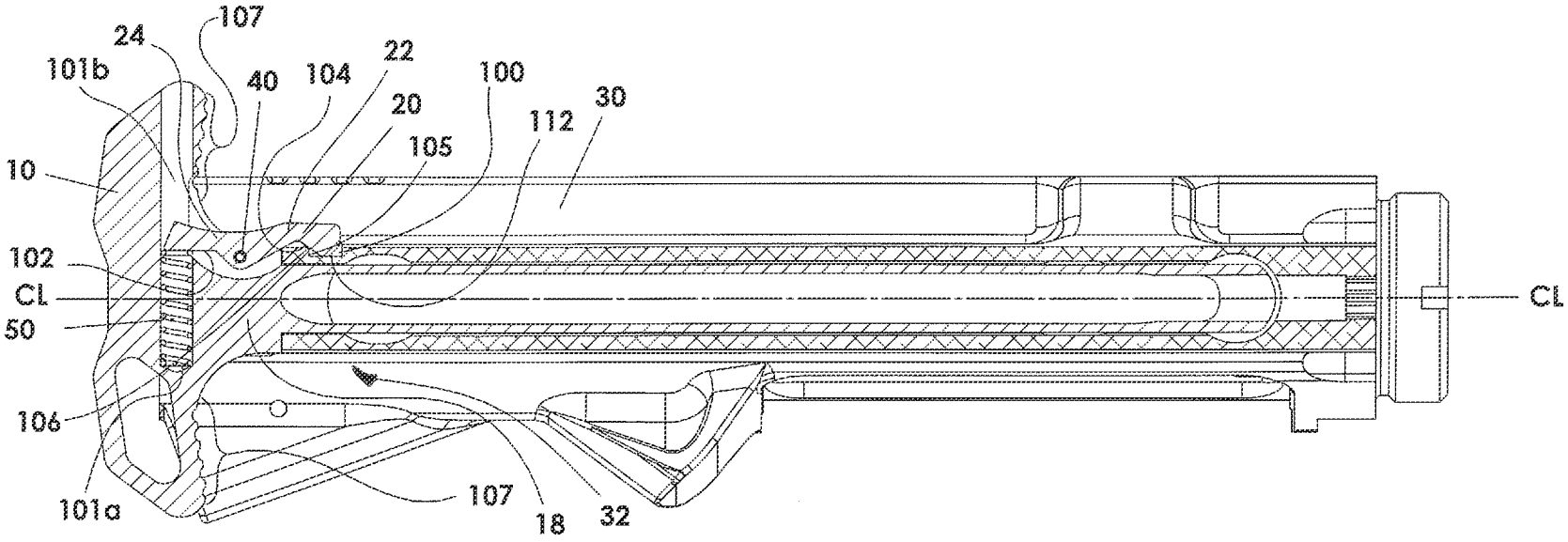
FIG. 4 is a section view taken along lines 4-4 of FIG. 3.
Figure 5:
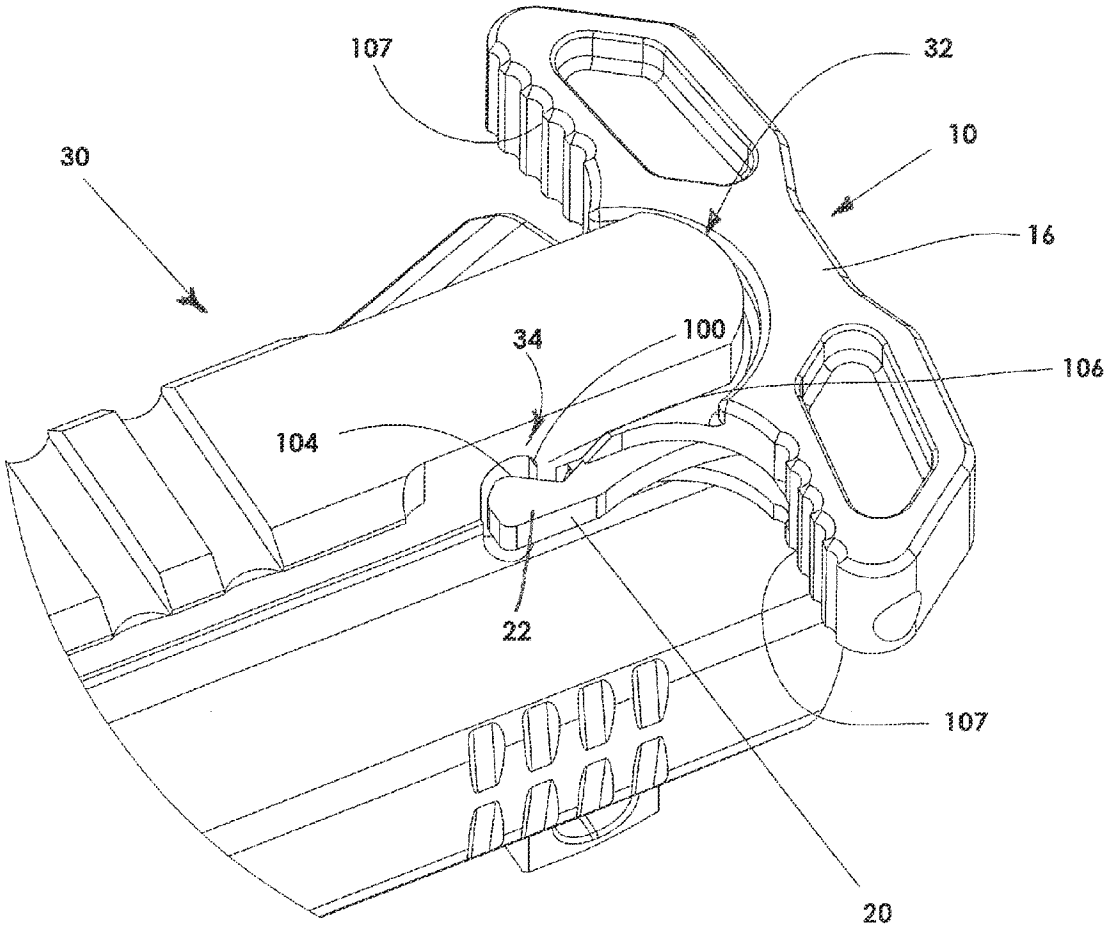
FIG. 5 is an enlarged view of circle 5 of FIG. 3.
Figure 6:
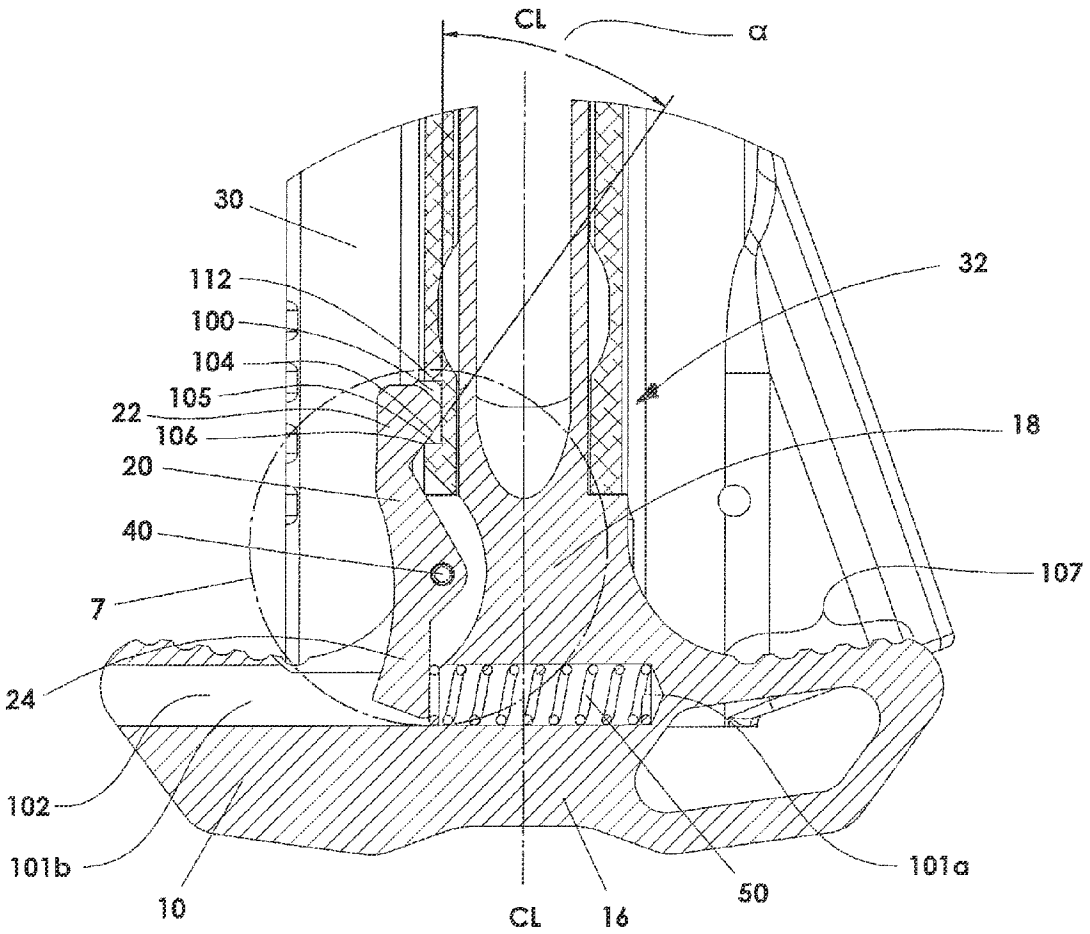
FIG. 6 is an enlarged view of circle 6 of FIG. 4.
Figure 7:
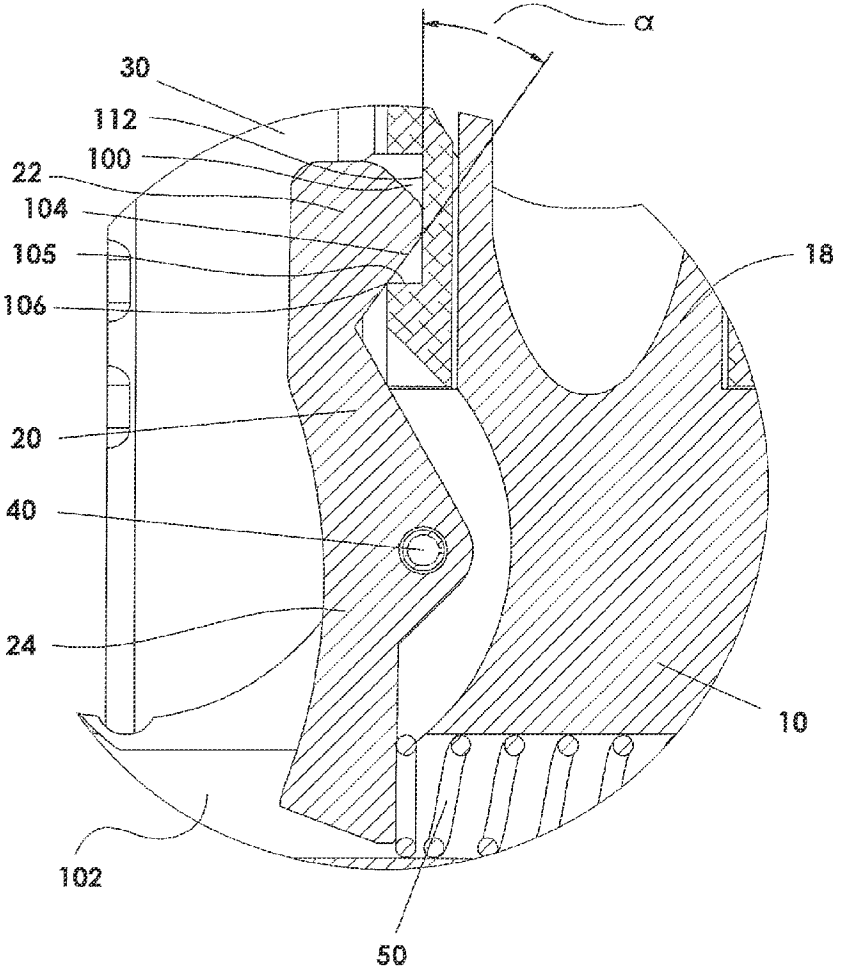
FIG. 7 is an enlarged view of the charging latch, angled latch surface, and the latch pocket of FIG. 6.
Figure 8:
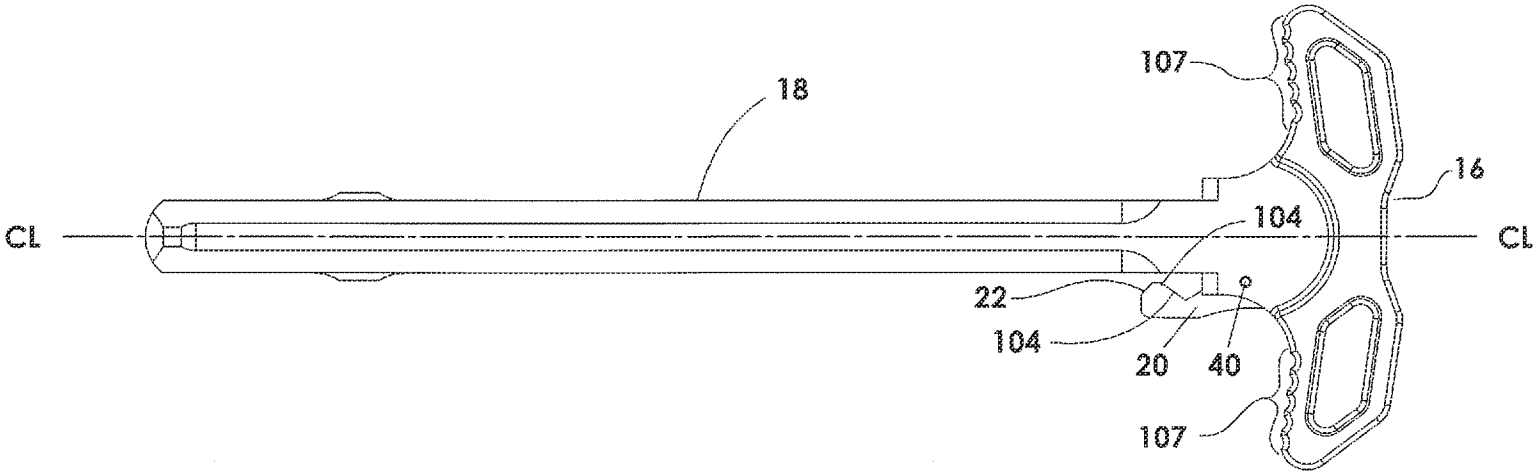
FIG. 8 is a perspective view of the charging handle apart from the upper receiver.

Referring to FIGS. 3-8, the present invention is a charging handle 10 having a base 16 and generally perpendicularly-oriented cross member 18 (FIG. 8) having an imaginary center line CL. Normal condition of an uncharged AR style rifle will start wherein the charging handle 10 is fully forward in an upper receiver 30 of a firearm (not illustrated) with a charging handle latch 20 engaged in a charging handle latch pocket 100 of upper receiver 30. The upper receiver has a first end 32 that is positioned near charging handle base 16. The upper receiver longitudinally receives the charging handle cross-member 18 (FIGS. 4, 6, and 8). Upper receiver 30 has a side 34 where latch pocket 100 is positioned. Latch pocket 100 includes a base surface 112 that may be parallel to cross member 18 as illustrated in FIG. 6.

Charging handle 10 is held in place by charging handle latch 20, and its interrelationship to a compression spring 50, a fulcrum pin 40, and charging handle latch pocket 100 that is positioned within a side of the upper receiver. Latch handle 20 has an upper arm 22 and a lower arm 24. In this uncharged state, compression spring 50 exerts expanding pressure between a bottom 101*a* of a spring bore 101*b* and a spring landing 102 of charging handle latch 20 (FIG. 6). This expanding pressure causes a clockwise torque of lower arm 24 around fulcrum pin 40. In turn, an equal and opposite force at an angled latch surface 104 of the upper arm 22 of charging handle latch 20 is directed downward into charging handle latch pocket 100, thereby retaining the changing handle latch 20 in its forward position.

Latch pocket 100 further includes a latch pocket surface 105 and an upper rear edge 106 that is configured to engage the angled upper latch arm of the charging handle latch. The upper edge makes contact with the angled latch surface 104. Rearward edge 106 may be an outwardly-extending protrusion that is best illustrated in FIG. 5 or a substantially 90 degree corner as illustrated in FIG. 6.

Latch surface 104 of the charging handle latch 20 is angled relative to a corresponding rearward edge 106 of latch pocket 100 and imaginary centerline CL. Angle $\alpha$ is the angle between angled latch surface 104 and imaginary center line CL. Angle $\alpha$ is in a range of 34-38 degrees with a preferred angle of 36 degrees. This angle range was found to provide a consistent force and is better able to resist rearward gas impulse.

During the charging operation, an operator will apply rearward directed force to the charging handle 10 on either of the handle surfaces 107, or both, depending on style of operation, training taken and whether the operator is left handed or right handed. As the charging handle latch 20 is connected to the charging handle 10 through fulcrum pin 40, this rearward force translates to a rearward differential force between the latch surface 104 and the upper rearward edge 106 of latch pocket 100. Referring now to FIGS. 4 and 7, since latch surface 104 is angled to latch pocket surface 105 and contacts rearward edge 106 of latch pocket 100. Rearward edge 106 is a protrusion that is engaged by the angled latch. Rearward edge 106 may be the only contact with the angled latch, as illustrated in enlarged FIG. 5. Latch surface 104 slides in a ramping fashion across rearward edge 106 of latch pocket 100, overcoming the opposing force applied by the compression spring 50.

Compression spring 50 exerts expanding pressure between a bottom of a spring bore and the spring landing of the charging handle. This force causes a clockwise torque around the fulcrum pin 40. In turn, this clockwise torque causes an equal and opposite force at the latch surface 104 directed downward into latch pocket 100 thereby retaining the charging handle 10 in its forward position. While it is possible to overcome the latching force applied by an operator, the latch applies a consistent force to holding the charging handle in place during normal firing operation.

Figure 1:
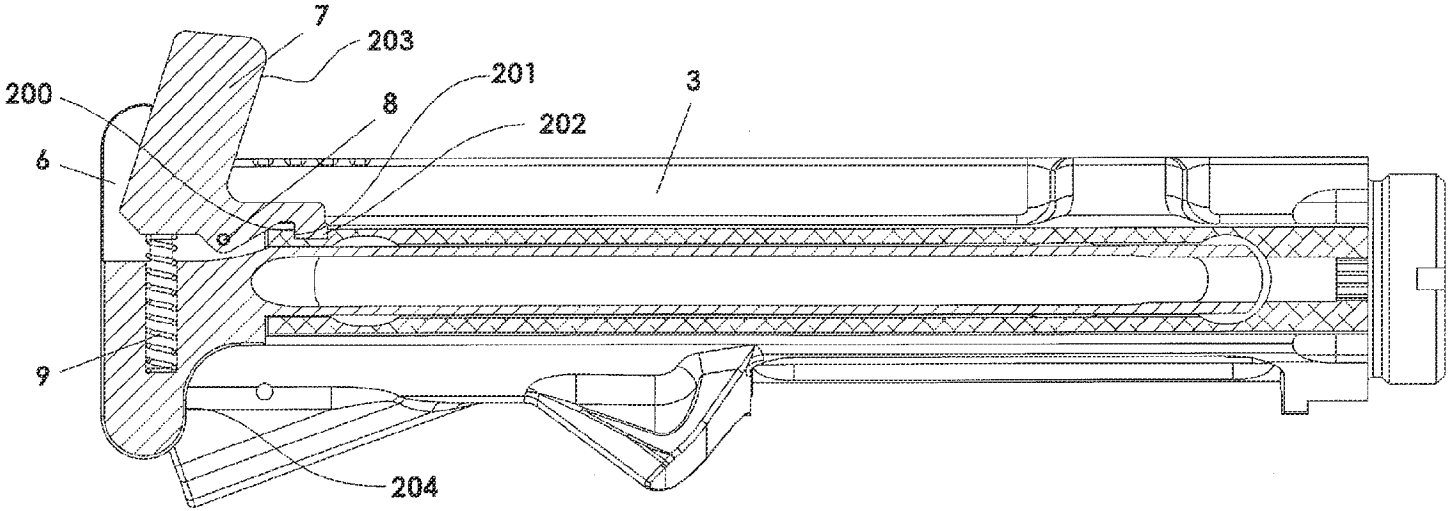
FIG. 1 is a section view of a prior art mil spec charging handle with a charging pivotable handle latch assembled within a portion of an upper receiver of a firearm.
Figure 2:
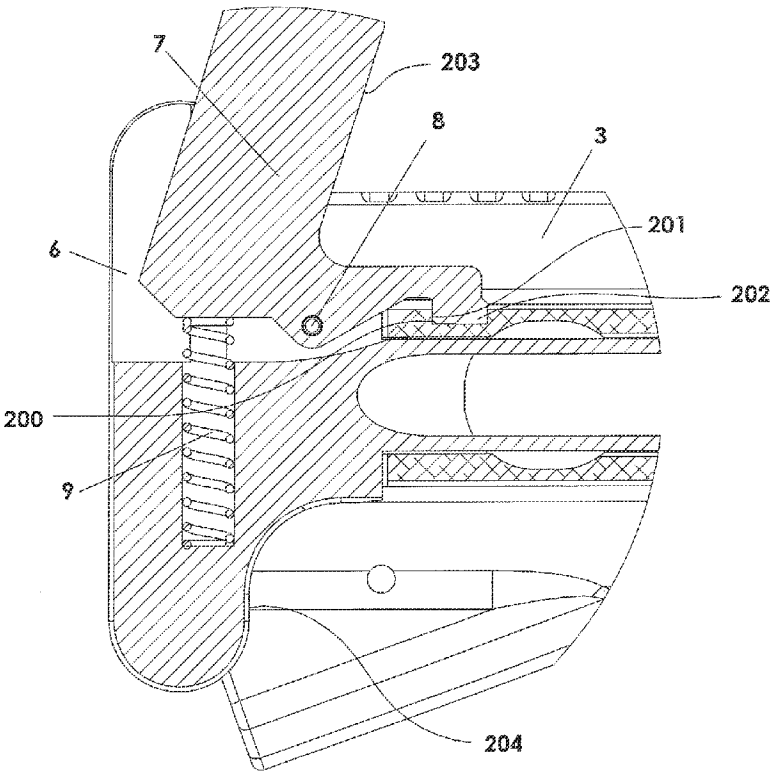
FIG. 2 is an enlarged view of the prior art mil spec charging latch of FIG. 1 illustrating its flat latch surface, and corresponding latch pocket.
Figure 3:
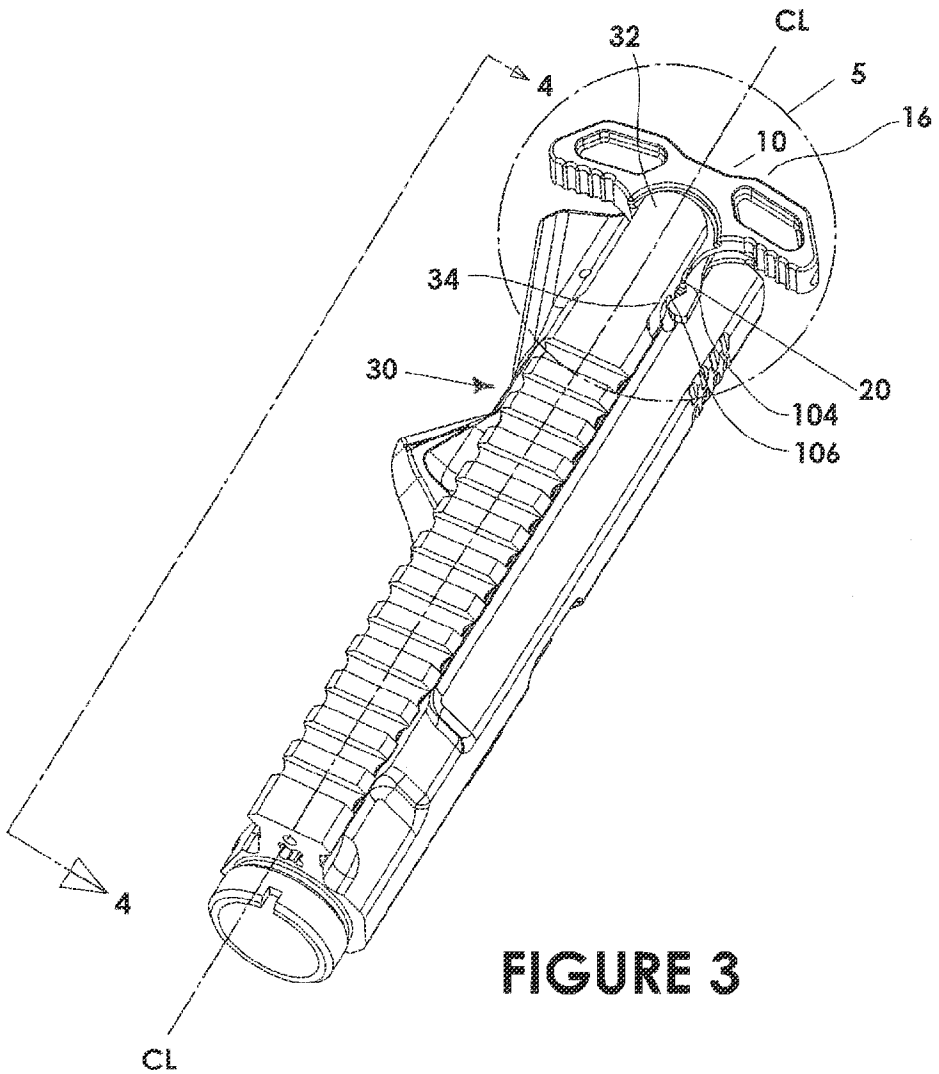
FIG. 3 is a front perspective view of the charging handle of the present invention assembled within an upper receiver of an AR rifle.

The result of this invention is that the latch and latch surface is angled rather than parallel to the surface of the latch pocket as in the prior art (see e.g., FIGS. 1 and 2). In the present invention, the charging handle latch engages the latch pocket via the angled relationship of latch surface to latch pocket and relative to the upper edge of the latch pocket. To disengage, the charging handle latch's latch surface is removed from the latch pocket by virtue of rearward force alone, applied anywhere across the charging handle surfaces. In contrast, the mil spec design requires that the operator disengage latched surfaces in a specific manner prior to operation of the charging handle.

The present invention charging handle 10 applies a consistent force to resist the disengagement of the latch along the entire length of engagement between angled latch surface 104 and rearward edge 106 of latch pocket surface 105 of latch pocket 100. Thus, the charging handle will only move rearward under the influence of the operator and not as a result of the operation of the firearm (weapon).

The illustrated embodiments are only examples of the present invention and, therefore, are non-limitive. It is to be understood that many changes in the particular structure, materials, and features of the invention may be made without departing from the spirit and scope of the invention. Therefore, it is the Applicant's invention that its patent rights not be limited by the particularly embodiments illustrated and described herein, but rather by the following claims interpreted according to accepted doctrines of claim interpretation, including the Doctrine of Equivalents, Doctrine of Claim Differentiation, and Reversal of Parts.

The invention claimed is:

1. A combination of a charging handle and an upper receiver of a firearm, wherein the upper receiver has a longitudinally extending axis, a first end, and a side, the combination comprising:

the charging handle including a base, a cross-member that is connected and substantially perpendicular to the base, and a charging latch that pivots about a fulcrum pin;

the base including a spring bore with an open end and a closed end surface, said base further including a compression spring positioned within the spring bore, said compression spring having a first end and a second end with the second end of the compression spring abutting the closed end surface of the spring bore;

the cross member being configured to be received lengthwise within the upper receiver substantially parallel to the longitudinally extending axis of the upper receiver;

the charging handle latch including a first arm and a second arm on opposite sides of the fulcrum pin; said first arm having an angled latch surface that forms an angle relative to an imaginary center line of the cross-member, said second arm contacting and biased by the first end of the compression spring intermediate of the open end and closed end surface and the second arm being contained within the base to prevent direct manual manipulation of the second arm; and the upper receiver including a latch pocket on the side of the upper receiver wherein the latch pocket includes a rearward edge;

wherein the angled latch surface is configured to engage the rearward edge of the latch pocket of the upper receiver.

2. The combination according to claim 1 wherein an angle between the angled surface and the latch pocket is in a range of 34 to 38 degrees.

3. The combination according to claim 2 wherein the angle is 36 degrees.

4. The combination according to claim 1 wherein the spring bore is positioned laterally within the base perpendicular to the cross-member.

5. The combination according to claim 1 wherein the rearward edge is an outwardly extending protrusion.

6. The combination according to claim 1 wherein the rearward edge is an outwardly extending substantially right angle corner.

7. The combination according to claim 5 wherein an angle between the angled surface and the latch pocket is in a range of 34 to 36 degrees.

8. The combination according to claim 7 wherein the angle is 36 degrees.

9. A charging handle configured to be received within an elongated upper receiver of a firearm comprising where the upper receiver has a longitudinally extending axis, a first end, and a side having a latch pocket; said latch pocket further including a base surface and a rearward edge, the charging handle comprising:

a base including a spring bore with an open end and a closed end surface, said base further including a compression spring positioned within the spring bore, said compression spring having a first end and a second end with the second end of the compression spring abutting the closed end surface of the spring bore;

a cross-member that is substantially perpendicular to the base; the cross-member being configured to be received lengthwise within the upper receiver substantially parallel to the longitudinally extending axis of the upper receiver such that the base is fully forward of the first end of the upper receiver; and a charging handle latch that pivots about a fulcrum pin, said charging handle latch including a first arm and a second arm on opposite sides of the fulcrum pin; said first arm having a latch pocket surface wherein said latch pocket surface has an angled latch surface relative to the cross-member, said second arm being biased against the first end of the compression spring and contained within the base;

wherein the angled latch surface engages the latch pocket of the upper receiver and contacts the rearward edge of the latch pocket forming an angle between the angled latch surface and the rearward edge of the latch pocket.

10. The charging handle according to claim 9 wherein the angle is in the range of 34 to 38 degrees.

11. The charging handle according to claim 10 where the angle is 36 degrees.

12. A method of applying a consistent force to a charging handle of a firearm to resist rearward movement, said method comprising:

providing a charging handle having a base and an elongated cross-member having an imaginary centerline, wherein said base is operably connected to and substantially perpendicular to the cross-member, said charging handle further including a charging latch that pivots about a fulcrum pin, the charging handle latch including a first arm and a second arm on opposite sides of the fulcrum pin; said first arm having an angled latch surface that forms an angle relative to the imaginary center line of the cross-member;

wherein the base includes a spring bore with an open end and a closed end surface, said base further including a compression spring positioned within the spring bore, said compression spring having a first end and a second end with the second end of the compression spring abutting the closed end surface of the spring bore, said second arm contacting and biased by the first end of the compression spring intermediate of the open end and closed end surface, the second arm being contained within the base to prevent direct manual manipulation of the second arm;

providing an elongated upper receiver having a first end and a second end and that the upper receiver being configured to longitudinally receive the cross-member;

the upper receiver including a latch pocket with the side of the upper receiver wherein the latch pocket includes a rearward edge;

inserting the cross-member of the charging handle within the upper receiver; and engaging the angled latch surface of the second arm of the charging handle latch within the latch pocket of the upper receiver and making contact with the rearward edge of the latch pocket.

13. The method according to claim 12 wherein, in engagement, an angle is created between the angled surface relative to the rearward edge and the imaginary centerline of the cross-member and wherein that angle is in a range from 34 degrees to 38 degrees.

14. The method according to claim 13 wherein the angle is 36 degrees.

15. The method according to claim 12 wherein the rearward edge is outwardly protruding.

16. The method according to claim 12 wherein the rearward edge is an outwardly protruding corner forming a right angle relative to a base surface of the latch pocket.

* * * * *